US008360269B1

(12) United States Patent
Chang

(10) Patent No.: US 8,360,269 B1
(45) Date of Patent: Jan. 29, 2013

(54) COMMUNICATION BOX

(75) Inventor: Hsi-Fan Chang, Guangdong (CN)

(73) Assignee: General Jack Technology Ltd., Dongguan, Guangdong (CN)

( * ) Notice: Subject to any disclaimer, the term of this patent is extended or adjusted under 35 U.S.C. 154(b) by 0 days.

(21) Appl. No.: 13/179,497

(22) Filed: Jul. 9, 2011

(51) Int. Cl.
*B65D 51/04* (2006.01)
*B65D 45/16* (2006.01)

(52) U.S. Cl. ..... 220/817; 220/324; 220/847; 220/840

(58) Field of Classification Search ..... 220/817, 220/834, 835, 847, 326, 840, 788, 9.2, 9.3, 220/4.28; 206/1.5, 581, 823; 16/231, 232, 16/272, 261
See application file for complete search history.

(56) References Cited

U.S. PATENT DOCUMENTS 5,067,625 A * 11/1991 Numata ..... 220/827
5,210,906 A * 5/1993 Aihara et al. ..... 16/232
5,647,652 A * 7/1997 Zalewski et al. ..... 312/324
6,003,716 A * 12/1999 Allison et al. ..... 220/326
7,635,064 B2 * 12/2009 Wang ..... 220/9.2

* cited by examiner

*Primary Examiner* — Anthony Stashick
*Assistant Examiner* — Don M Anderson

(57) ABSTRACT

A communication box includes a box body and a box lid. The box body has an accommodation space therein. The box lid includes a lid body and two engaging members. Upper and lower ends of the two engaging members are detachably connected to the box body. The two engaging members are respectively and pivotally connected two opposing sides of the lid body, so that the two engaging members are rotatable relative to the lid body. Compared the conventional communication box, the communication box of the present invention can be opened in different ways. Through one of the two engaging members, either side of the box lid can be opened. Alternatively, the box lid can be detached from the box body through disengagement of the two engaging members. The present invention can be used in different occasions and is convenient for operation, without limitation of space.

4 Claims, 8 Drawing Sheets

M-M

N-N

COMMUNICATION BOX

BACKGROUND OF THE INVENTION

1. Field of the Invention

The present invention relates to a communication box, and more particularly to one which can be opened in different ways and is convenient for use.

2. Description of the Prior Art

These days, there are many different boxes for electronic products, such as communication boxes. A conventional communication box comprises a box body and a box lid which are coupled to each other. The ways to connect the box lid and the box body are as follows:

1. Both sides of the box lid are fixed with screws. This connection way is inconvenient because there are too many screws required. This is not cost-effective and consumes time to assemble and disassemble the communication box.

2. One side of the box lid is pivotally connected to the box body and the other side of the box lid is fixed. This connection way is somewhat improved, compared to the first connection way. However, sometimes the communication box cannot be opened because the side to be opened is blocked by other articles. This is very inconvenient for the operator to work. Accordingly, the inventor of the present invention has devoted himself based on his many years of practical experiences to solve these problems.

SUMMARY OF THE INVENTION

The primary object of the present invention is to provide a communication box which can be opened in different ways and is convenient for use.

In order to achieve the aforesaid object, the communication box of the present invention comprises a box body and a box lid. The box lid comprises a lid body and two engaging members. The two engaging members are respectively and pivotally connected two opposing sides of the lid body. The two engaging members are rotatable relative to the lid body. Upper and lower ends of the two engaging members are detachably connected to the box body.

Preferably, each of the engaging members has a pivot hole thereon, the lid body has a mating pivot, and the pivot is inserted in the pivot hole of the relative engaging member.

Preferably, the pivot hole has an axial opening facing the lid body, and the pivot hole has a C-shaped cross-section.

Preferably, each of the engaging members comprises a main body. The main body has a lower end formed with a resilient engaging hook. The resilient engaging hook has a U-shaped configuration and comprises a press portion and a connection portion. The press portion is integrally formed with the connection portion. The press portion has a protrusion protruding downward from a lower end thereof. Two opposing sides of the box body each has a first receiving recess and an engaging groove underneath the first receiving recess. When the engaging members are coupled to the box body, the resilient engaging hook is received in the first receiving recess. The press portion is exposed out of the box body. The protrusion is engaged in the engaging groove.

The present invention has the following advantages.

The upper and lower ends of the two engaging members are detachably connected to the box body, and the two engaging members are pivotally connected to the two opposing sides of the lid body, so that the lid body and the two engaging members are rotatable with each other. Compared the conventional communication box, the communication box of the present invention can be opened in different ways. Through one of the two engaging members, either side of the box lid can be opened. Alternatively, the box lid can be detached from the box body through disengagement of the two engaging members. The present invention can be used in different occasions and is convenient for operation, without limitation of space.

The two engaging members each have the resilient engaging hook to engage with the box body. The resilient engaging hook has the U-shaped configuration with the press portion exposed out of the box body. The press portion can be pressed upward to disengage the engaging member from the box body, which is convenient for operation.

The two sides of the box body each have the accommodation chamber to accommodate the main body of the relative engaging member. When the box lid is locked to the box body, the two engaging members are received in the two sides of the box body, so that the communication box of the present invention is compact and small in size. The outer surface of the communication box is smooth, which is beneficial for arrangement and storage.

DETAILED DESCRIPTION OF THE PREFERRED EMBODIMENTS

Embodiments of the present invention will now be described, by way of example only, with reference to the accompanying drawings.

Figure 1:
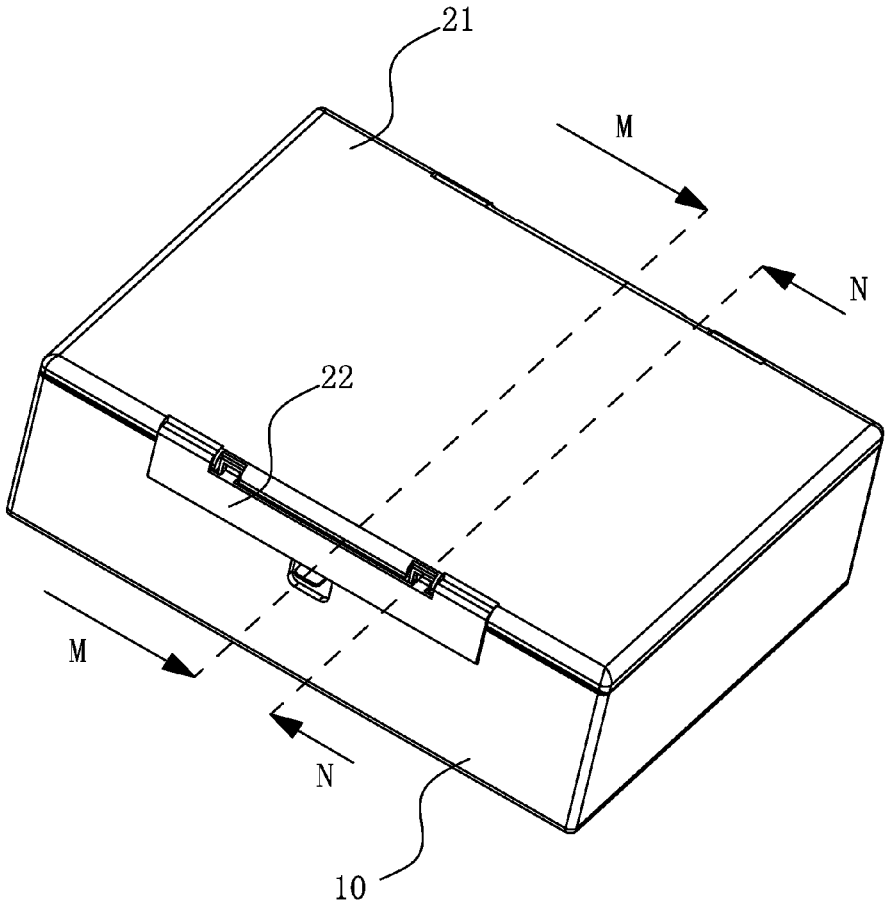
FIG. 1 is a perspective view according to a preferred embodiment of the present invention.
Figure 2:
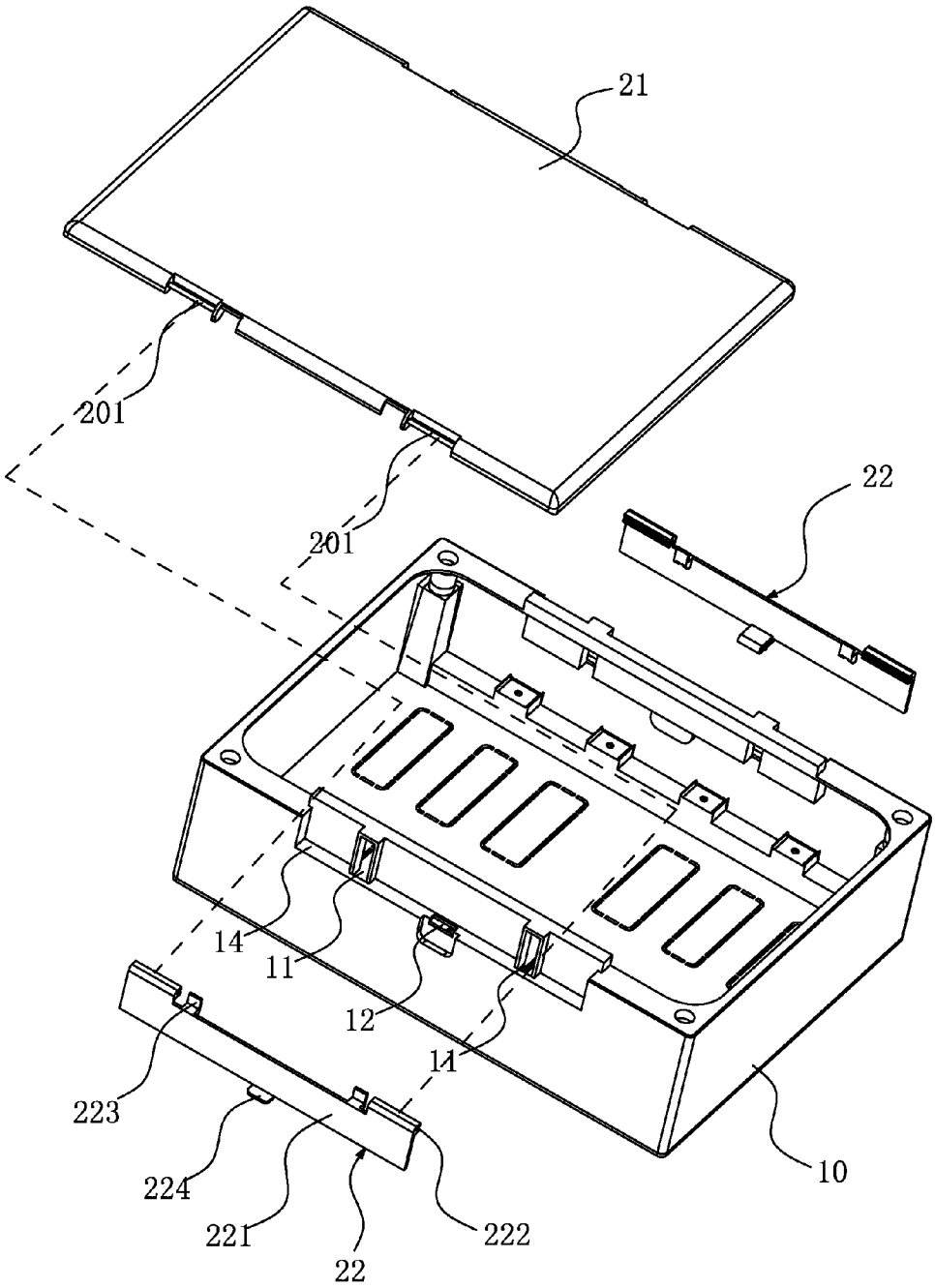
FIG. 2 is an exploded view according to the preferred embodiment of the present invention.

As shown in FIG. 1 through FIG. 8, the communication box according to a preferred embodiment of the present invention comprises a box body 10 and a box lid 20. The box body 10 has an accommodation space therein. The box lid 20 comprises a lid body 21 and two engaging members 22, as shown in FIG. 2.

The two engaging members 22 are pivotally connected two opposing sides of the lid body 21, respectively. The two engaging members 22 are rotatable relative to the lid body 21. Upper and lower ends of the two engaging members 22 are connected to the box body 10.

Each engaging member 22 comprises a main body 221. The main body 221 has a pivot hole 222 thereon. Left and right sides of the lid body 21 each have a pivot 201. The pivot 201 is inserted in the pivot hole 222 of the relative engaging member 22. In this embodiment, the pivot hole 222 has an axial opening facing the lid body 21. The pivot hole 222 has a C-shaped cross-section. In this way, the two engaging members 22 can be coupled to the pivot 201 with ease. The pivot 201 is aligned with the axial opening of the pivot hole 222 and then pushed into the pivot hole 222. Preferably, the engaging member 22 has two spaced pivot holes 222 in an axial direction. The lid body 21 has two mating pivots 201 at each of the left and right sides thereof.

Figure 8:
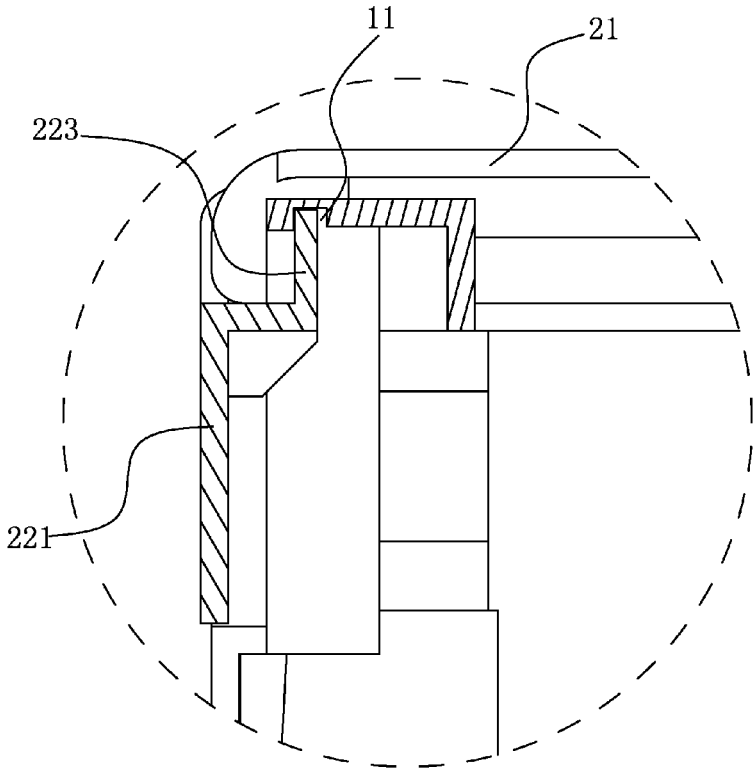
FIG. 8 is a partial sectional view taken along line M-N of FIG. 1.

For the upper and lower ends of the two engaging members 22 to be coupled to the box body 10 with ease, the main body 221 has an upper end formed with two spaced auxiliary engaging hooks 223. The two auxiliary engaging hooks are located between the two pivot holes 222 at the same side. Two opposing sides of the box body 10 each have two spaced auxiliary engaging recesses 11 which are located between the two pivots 201 at the same side. The auxiliary engaging hooks 223 extend from the upper end of the main body 221. As shown in FIG. 8, the auxiliary engaging hooks 223 are engaged in the auxiliary engaging recesses 11. The main body 221 has a lower end formed with a resilient engaging hook 224. The resilient engaging hook 224 has a U-shaped configuration, and comprises a press portion 225 and a connection portion 226. The press portion 225 is integrally formed with the connection portion 226. The press portion 225 has a protrusion 227 protruding downward from a lower end thereof. The two opposing sides of the box body 10 each has a first receiving recess 12 and an engaging groove 13 underneath the first receiving recess 12. The resilient engaging hook 224 is received in the first receiving recess 12. The press portion 225 is exposed out of the box body 10, and the protrusion 227 is engaged in the engaging groove 13. Thus, when one of the engaging members 22 is disengaged, the lid body 21 of the box lid 20 can be opened upward with the other engaging member 22 as a pivot. This won't influence the connection of the other engaged engaging member 22 and the box body 10.

In this embodiment, the two sides of the box body 10 each have an accommodation chamber 14 to accommodate the main body 221 of the relative engaging member 22. When the box lid 20 is locked to the box body 10, the two engaging members 22 are received in the two sides of the box body 10, so that the communication box of the present invention is compact and small in size. The outer surface of the communication box is smooth, which is beneficial for arrangement and storage.

Figure 3:
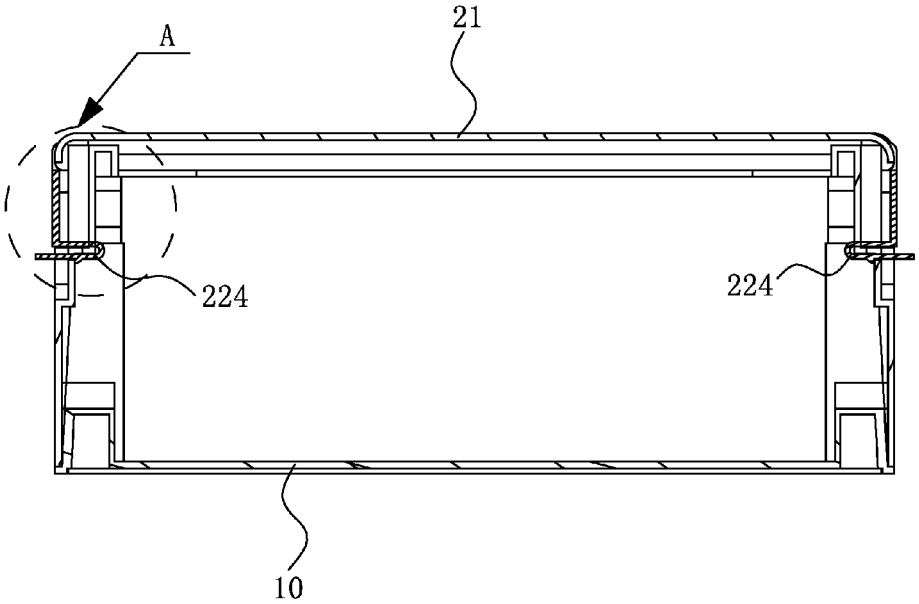
FIG. 3 is a cross-sectional view taken along line M-N of FIG. 1.
Figure 4:
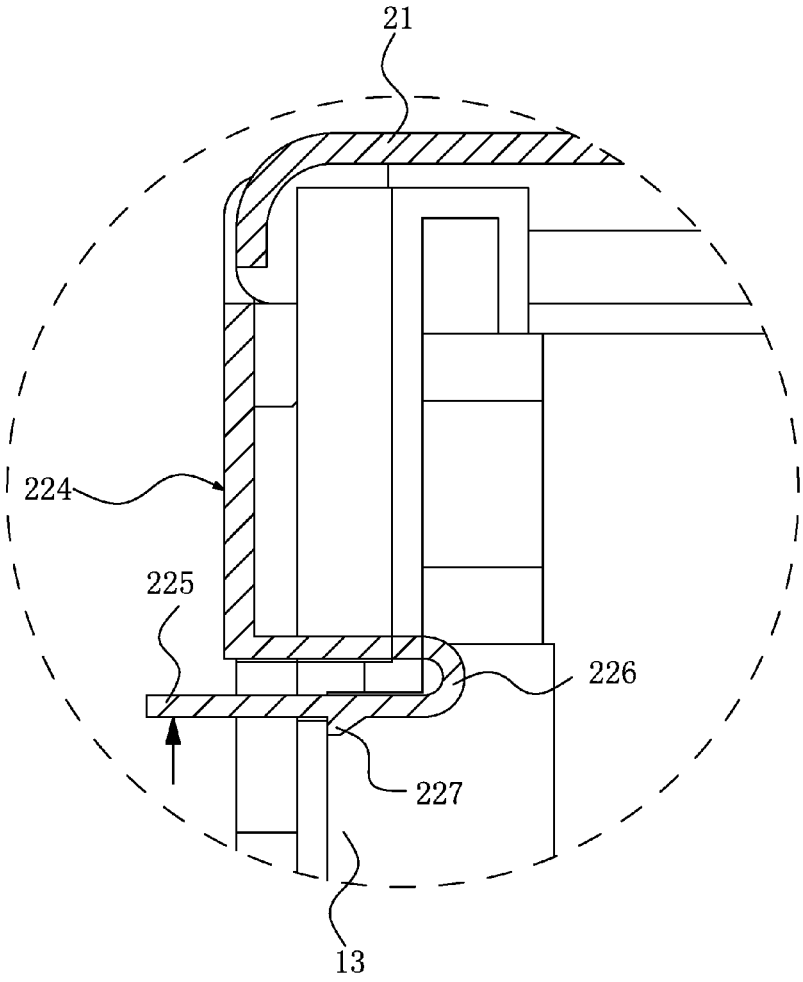
FIG. 4 is an enlarged view of the circle A in FIG. 3.
Figure 5:
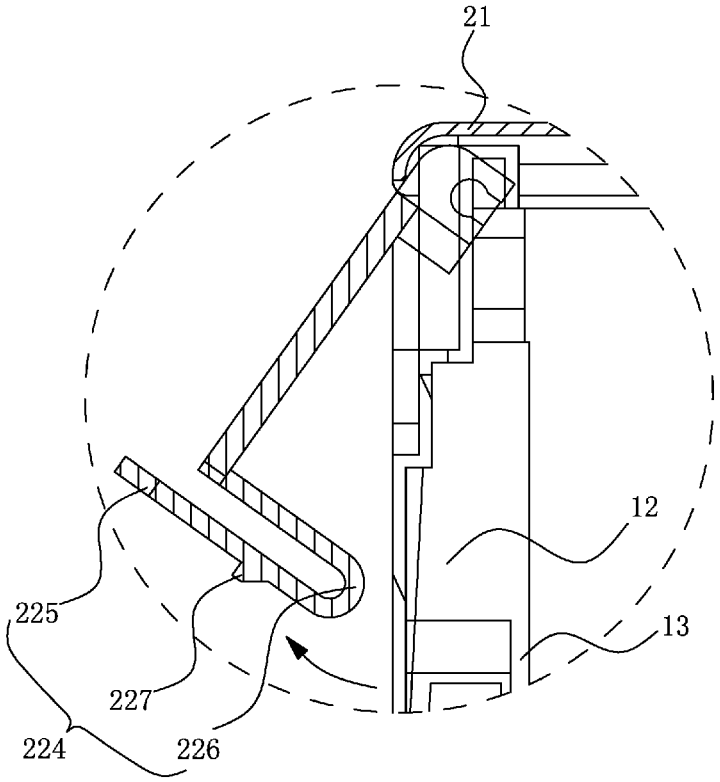
FIG. 5 is an enlarged view showing that the resilient engaging hook is disengaged from the box body.

When in use, the box lid 20 is placed on the box body 10 and the two engaging members 22 are engaged with the box body 10 so as to achieve connection of the box lid 20 and the box body 10. As shown in FIG. 3, the box lid 20 and the box body 10 are in an engaged state. The lid body 21 is disposed on top of the box body 10. The two engaging members 22 are engaged with the box body 10.

Figure 6:
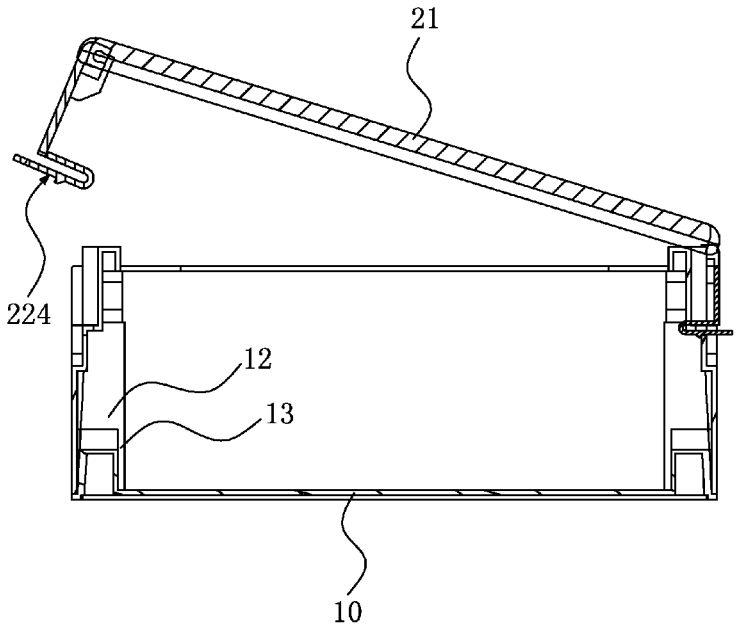
FIG. 6 is a cross-sectional view showing that one side of the box lid is opened.
Figure 7:
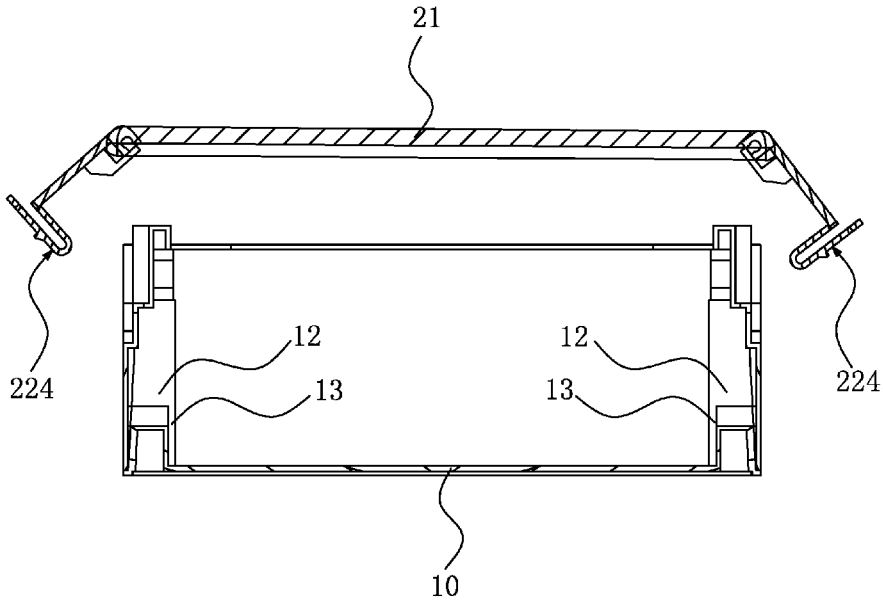
FIG. 7 is a cross-sectional view showing that both sides of the box lid are opened.

When the user wants to open the box lid 20, one of the engaging members 22 can be disengaged from the box body 10. The press portion 225 of the resilient engaging hook 224 is pressed upward to release the protrusion 227 from the box body 10, and the resilient engaging hook 224 is disengaged from the first receiving recess 12. After that, the resilient engaging hook 224 is turned upward to release the auxiliary engaging hooks 223 from the auxiliary engaging recesses 11, so that the lid body 21 can be opened with the other engaged engaging member 22 and the relative pivot 201 as the pivot, as shown in FIG. 6. The two engaging members 22 can be disengaged from the box body 10, such that the box lid 20 is detached from the box body 10, as shown in FIG. 7.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A communication box, comprising a box body and a box lid, the box lid comprising a lid body and two engaging members, the two engaging members being respectively and pivotally connected to opposing sides of the lid body, the two engaging members being rotatable relative to the lid body, upper and lower ends of the two engaging members being detachably connected to the box body, wherein each of the engaging members comprises a main body, the main body having a lower end formed with a resilient engaging hook, the resilient engaging hook having a U-shaped configuration and comprising a press portion and a connection portion, the press portion being integrally formed with the connection portion, the connection portion having a protrusion protruding downward from a lower end thereof, two opposing sides of the box body each having a first receiving recess and an engaging groove underneath the first receiving recess, when the engaging members being coupled to the box body, the resilient engaging hook being received in the first receiving recess, the press portion being exposed out of the box body, the protrusion being engaged in the engaging groove, the main body of each of the two engaging members has an upper end formed with an auxiliary engaging hook, and the two opposing sides of the box body each have an auxiliary engaging recess for engagement of the auxiliary engaging hook.

2. The communication box as claimed in claim 1, wherein the auxiliary engaging hook extends from the upper end of the main body, and the auxiliary engaging hook is engaged in the auxiliary engaging recess.

3. The communication box as claimed in claim 2, wherein the main body has two auxiliary engaging hooks, and the two opposing sides of the box body each have two auxiliary engaging recesses.

4. The communication box as claimed in claim 3, wherein the two sides of the box body each have an accommodation chamber to accommodate the main body of the relative engaging member.

* * * * *